US012397972B1

(12) United States Patent
Prusko et al.

(10) Patent No.: US 12,397,972 B1
(45) Date of Patent: Aug. 26, 2025

(54) DISPENSING CLOSURE

(71) Applicant: AptarGroup, Inc., Crystal Lake, IL (US)

(72) Inventors: Curt Prusko, Wauwatosa, WI (US); Kelly Smith, East Troy, WI (US)

(73) Assignee: AptarGroup, Inc., Crystal Lake, IL (US)

( * ) Notice: Subject to any disclaimer, the term of this patent is extended or adjusted under 35 U.S.C. 154(b) by 0 days.

(21) Appl. No.: 18/876,468

(22) PCT Filed: Jul. 15, 2024

(86) PCT No.: PCT/US2024/038001

§ 371 (c)(1),
(2) Date: Dec. 18, 2024

(87) PCT Pub. No.: WO2025/019408

PCT Pub. Date: Jan. 23, 2025

Related U.S. Application Data

(60) Provisional application No. 63/514,029, filed on Jul. 17, 2023.

(51) Int. Cl.
*B65D 47/20* (2006.01)

(52) U.S. Cl.
CPC ..... *B65D 47/2006* (2013.01)

(58) Field of Classification Search
CPC ..... B65D 47/2006
See application file for complete search history.

(56) References Cited

U.S. PATENT DOCUMENTS

| | | | | |
|---|---|---|---|---|
| 4,962,869 | A | 10/1990 | Gross | |
| 5,341,960 | A | 8/1994 | Lay | |
| 5,370,284 | A * | 12/1994 | Dirksing | B65D 47/2006 222/536 |
| 6,283,333 | B1 | 9/2001 | Knickerbocker | |
| 6,832,700 | B2 * | 12/2004 | Roberts | B65D 47/2006 222/546 |

OTHER PUBLICATIONS

International Search Report and Written Opinion mailed on Oct. 22, 2024 for PCT/US2024/038001 of which this is the U.S. national phase application.

* cited by examiner

*Primary Examiner* — Donnell A Long
(74) *Attorney, Agent, or Firm* — Wood, Phillips, Katz, Clark & Mortimer

(57) ABSTRACT

A dispensing closure (40, 40A, 40B) for a fluent substance-containing system, such as a container, includes a body (54, 54A, 54B) for receiving the fluent substance from the system, and a pivotable actuator (60, 60A, 60B) assembled with the body (54, 54A, 54B). The actuator (60, 60A, 60B) has a back region (116) opposite its outlet end (132) and having a central cam element (150, 150A, 150B) for frictionally engaging the closure body (54, 54A, 54B) to maintain the actuator in an open, dispensing position. The actuator back region (116) further includes at least one rib (160, 160A, 160B) located adjacent to the central cam (150, 150A, 150B) to resist movement of the actuator (60, 60A, 60B) into the open, dispensing position. The rib (160, 160A, 160B) has an initial configuration and a permanently deformed configuration after movement of the actuator (60, 60A, 60B) into the open, dispensing position.

15 Claims, 14 Drawing Sheets

DISPENSING CLOSURE

PRIORITY

This application claims priority of U.S. Provisional Patent Application No. 63/514,029, filed Jul. 17, 2023, the entire contents of which is incorporated herein by reference.

TECHNICAL FIELD

The present invention relates generally to a dispensing closure for a container or other system that contains a fluent substance.

BACKGROUND OF THE INVENTION

Technical Problems Posed by the Prior Art

Closures are employed to selectively prevent or permit communication between the exterior and interior of a system through an opening in the system. Such a system might take the form of a machine or a container such as a bottle or pouch, etc. A typical closure includes at least (1) a receiving structure (e.g., a body, base, fitment, etc.) at an opening to the system interior, and (2) a closing element (e.g., a lid, cover, overcap, pivotable disc top type actuator, etc.) that is cooperatively received by the receiving structure.

The receiving structure of the closure can typically be either (1) a separate structure that (a) can be attached at such a system opening, and (b) defines at least one passage through the receiving structure for communicating through such a system opening with the interior of such a system, or (2) an integral structure that is a unitary portion of such a system and that defines at least one passage through the integral structure such that the passage functions as the opening to the system, per se.

The closing element typically is movable relative to the receiving structure passage between (1) a fully closed position occluding the passage, and (2) an open position at least partially exposing the passage. Some closures may include additional elements like tamper-evident features or locking elements.

A closure specifically designed for dispensing a fluent substance may be described as a dispensing closure. Various fluent materials or substances (including oils, lotions, creams, gels, liquids, food items, granules, powders, etc.) may be packaged in a rigid, flexible, or collapsible container having a dispensing closure that can be opened and closed. A flexible container may be pressurized by a user to force the fluent substance from the container and through the closure body to dispense the fluent substance at a target region or onto a target surface area. If the container is a bottle, pouch, or other such container, then such a container with the closure mounted thereon and the contents stored therein may be characterized as a "package".

One type of dispensing closure is a toggle action type, which typically is provided with a closing element in the form of a generally flat, disc top type actuator or a domed type actuator for dispensing a fluent substance. A user of such a closure will typically encounter the actuator in a closed, non-dispensing position. The actuator may be provided with a region for being pressed upon by a user of the closure to toggle, tilt, pivot, or otherwise rotate the actuator with respect to a stationary portion of the closure (e.g., closure body), moving the actuator from the closed position into an open position such that a fluent substance may be dispensed through the closure. Such an actuator may subsequently be pressed upon by a user, at a different region of the actuator, to toggle, pivot, or otherwise rotate the actuator back into the closed, non-dispensing position.

The inventors of the present invention have noted that, in some applications, such toggle action type closures, when installed in or on a system (e.g., a container of a fluent substance), may be susceptible to a likelihood of inadvertent opening during manufacturing, shipping, or handling, especially in e-commerce conditions, which can result in premature or messy leaking of the fluent substance from the closure. The likelihood of inadvertent opening of such a closure may be prevented, or at least minimized, by applying an adhesive seal or a film wrap around at least a portion of the closure to mechanically prevent movement of the actuator until the seal or wrap has been removed by a user of the closure. Such additional seals or wraps may increase the cost of the closure, require additional manufacturing steps, adversely affect sustainability claims, or present a nuisance to the user who must remove such a seal or wrap.

The inventors of the present invention have further determined that some toggle action type closures, those having a rotational or twist-type locking mechanism, may have unacceptably large torques required of a user for effectuating the locking and unlocking operations. The inventors have further found that liquid tight sealing of such types of closures may be difficult to achieve, especially in e-commerce type scenarios.

The inventors of the present invention have further determined that some toggle action type closures, those having a rotational or twist-type locking mechanism, may require the user to perform additional actions in order to open the closure.

The inventors of the present invention have determined that it would be desirable to provide an improved toggle action dispensing closure for preventing or minimizing the likelihood of inadvertent opening of the closure while further providing improved leak resistance experienced during manufacturing, shipping, or handling of the package containing the closure, especially in e-commerce conditions.

The inventors of the present invention have further determined that it would be beneficial to provide an improved toggle action dispensing closure that would facilitate repeatable and straightforward actuation of the closure by a user without any special motions or actions required of the user.

The inventors of the present invention have also determined that it would be desirable to provide an improved toggle action dispensing closure that can be configured for use with a container of a fluent substance so as to have one or more of the following advantages: (1) an improved ease of manufacture and/or assembly, and/or (ii) a reduced cost of manufacture and/or assembly.

The inventors of the present invention have invented a novel structure for a toggle action dispensing closure for use with a system, which could be a container or other type of system, wherein the closure includes various advantageous features not heretofore taught or contemplated by the prior art.

BRIEF SUMMARY OF THE INVENTION

According to broad aspects of one form of the present invention, a dispensing closure is provided for a system having an opening between an exterior of the system and an interior of the system where a fluent substance may be stored. The dispensing closure has a closure body that can be located at the system opening and that defines a lower end for communicating with the system. The closure body includes an upper end and a body flow passage to accommodate the flow of a fluent substance through the closure body. The dispensing closure includes an actuator that is rotatably mounted to the closure body for occluding the body flow passage to prevent flow of a fluent substance through the dispensing closure when the actuator is in a closed, non-dispensing position and for permitting flow of a fluent substance through the dispensing closure when the actuator is rotated to an open, dispensing position. The actuator further includes a dispensing flow passage having an inlet end that is in communication with the body flow passage and having an outlet end which permits dispensing through the actuator in the open, dispensing position. The actuator has a back region opposite the outlet end and has a central cam element thereon for frictionally engaging the closure body to maintain the actuator in the open, dispensing position, and the back region includes at least one rib located adjacent the central cam to resist the actuator from moving into the open, dispensing position. The at least one rib has an initial (i.e., as molded) configuration prior to movement of the actuator into the open, dispensing position and the at least one rib has a permanently deformed configuration after movement of the actuator into the open, dispensing position. The dispensing closure can prevent or minimize the likelihood of inadvertent opening while further providing improved leak resistance experienced during manufacturing, shipping, or handling of the package containing the closure, especially in e-commerce conditions. Furthermore, the dispensing closure facilitates repeatable and straightforward actuation of the closure by a user without any special motions or actions required of the user in the field of disc-top type dispensing closures.

In one preferred form of the present invention, the at least one rib has the form of a pair of ribs that are located on the back region of the actuator and on opposite sides of the central cam element. Preferably, the pair of ribs are equidistantly spaced from the central cam element along a circumference of the back region of the actuator. More preferably, the closure body defines a central axis extending between the lower end and the upper end, and the pair of ribs define a central angle of between about 30 degrees and about 50 degrees relative to the central axis (when viewed in a plane that is perpendicular to the central axis).

According to another form of the present invention, the at least one rib extends parallel to the central axis along the back region of the actuator.

In another preferred form of the present invention, the at least one rib has a substantially triangular cross-sectional shape in a plane that is normal to the central axis.

In an alternative form of the present invention, the at least one rib has a substantially semi-circular cross-sectional shape in a plane that is normal to the central axis.

In yet another form of the present invention, the at least one rib has a substantially flat abutment face for confronting the closure body in the closed, non-dispensing position, and the abutment face extends in a plane that is normal to the central axis.

In one aspect of the present invention, the actuator is configured with a first actuation force when first moved between its closed, non-dispensing position and its open, dispensing position. Furthermore, the actuator is configured with a second actuation force when subsequently moved between its closed, non-dispensing position and its open, dispensing position, whereby the first actuation force is greater than the second actuation force.

According to another preferred form of the present invention, the at least one rib defines a pair of angled side walls that terminate in an edge that extends substantially parallel to the central axis.

In still another form of the present invention, the outer wall of the closure body terminates in a sloping upper surface confronting the at least one rib, wherein the sloping upper surface is arranged to slope downwardly in a direction away from the at least one rib.

In one aspect of the present invention, the actuator includes a pair of oppositely extending protrusions, and the closure body includes an outer wall having a pair of facing recesses therein to each receive a different one of the protrusions.

In one preferred form of the present invention, the at least one rib and the central cam element are integrally formed with the actuator.

According to another preferred form of the present invention, the initial movement of the at least one rib from its initial configuration into its permanently deformed configuration does not generate any frangible pieces of the actuator and/or the closure body.

Preferably, the closure body is adapted for use with a system that is a container defining the opening and in which the closure body is one of: a separate structure for being attached to the container at the container opening; or an integral structure that is a unitary part of a container formed at the container opening.

According to another form of the present invention, the dispensing closure is in combination with a system that is a container of a fluent substance. The closure and container together defining a package.

It should be appreciated that the invention may include any or all of the above-described features, include only one of the above features, more than one of the above features, and any combination of the above features. Furthermore, other objects, features and advantages of the invention will become apparent from a review of the entire specification including the appended claims and drawings.

BRIEF DESCRIPTION OF THE DRAWINGS

In the accompanying drawings forming part of the specification, in which like numerals are employed to designate like parts throughout the same.

FIG. 4 shows the flat abutment face in a confronting configuration relative to the sloping upper surface of the closure body wall;

FIG. 5 shows the ribs located on opposite sides of the central cam on the back region of the actuator;

FIG. 6A shows the preferred embodiment of the ribs on the rear of the actuator;

FIG. 10 shows the actuator moved away from the closed, non-dispensing position by five degrees;

FIG. 11 shows the actuator moved away from the closed, non-dispensing position by 10 degrees;

FIG. 12 shows the actuator moved away from the closed, non-dispensing position by 15 degrees;

FIG. 13 shows the actuator moved away from the closed, non-dispensing position by 22 degrees into the fully open, dispensing position;

FIG. 14 shows the ribs of the actuator having a rounded form with a semi-circular or arcuate cross-section (in the horizontal plane); FIG. 15 shows the ribs of the actuator having a larger rounded form with a semi-circular or arcuate cross-section (in the horizontal plane) and located closer to the central cam member of the actuator.

DESCRIPTION OF THE PREFERRED EMBODIMENTS

Figure 1:
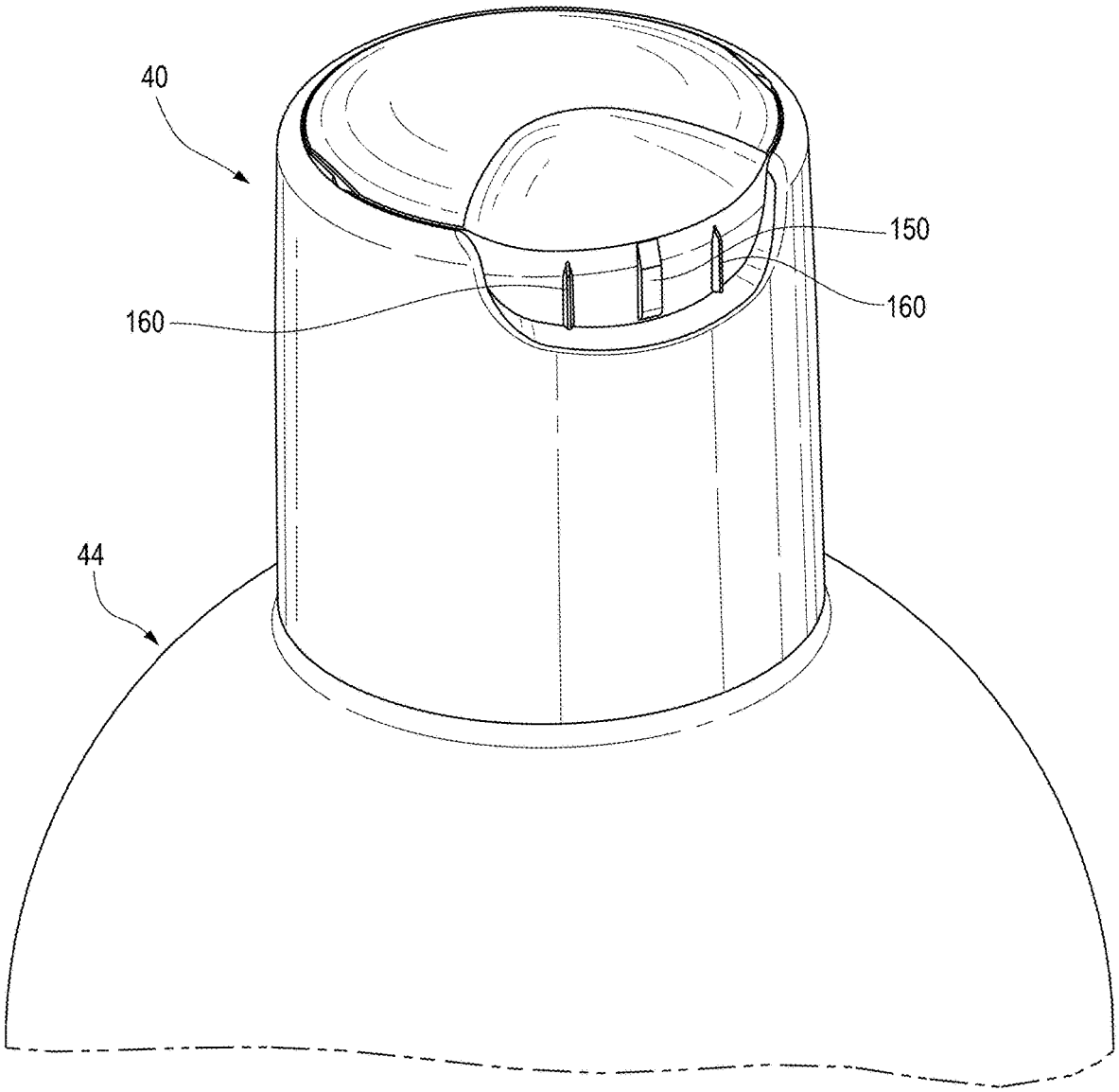
FIG. 1 is an isometric view, taken from above and the rear, of a first illustrated embodiment of a dispensing closure of the present invention shown installed at the opening of a container of a fluent substance wherein only a fragmentary, upper portion of the container is illustrated in FIG. 1.
Figure 1A:
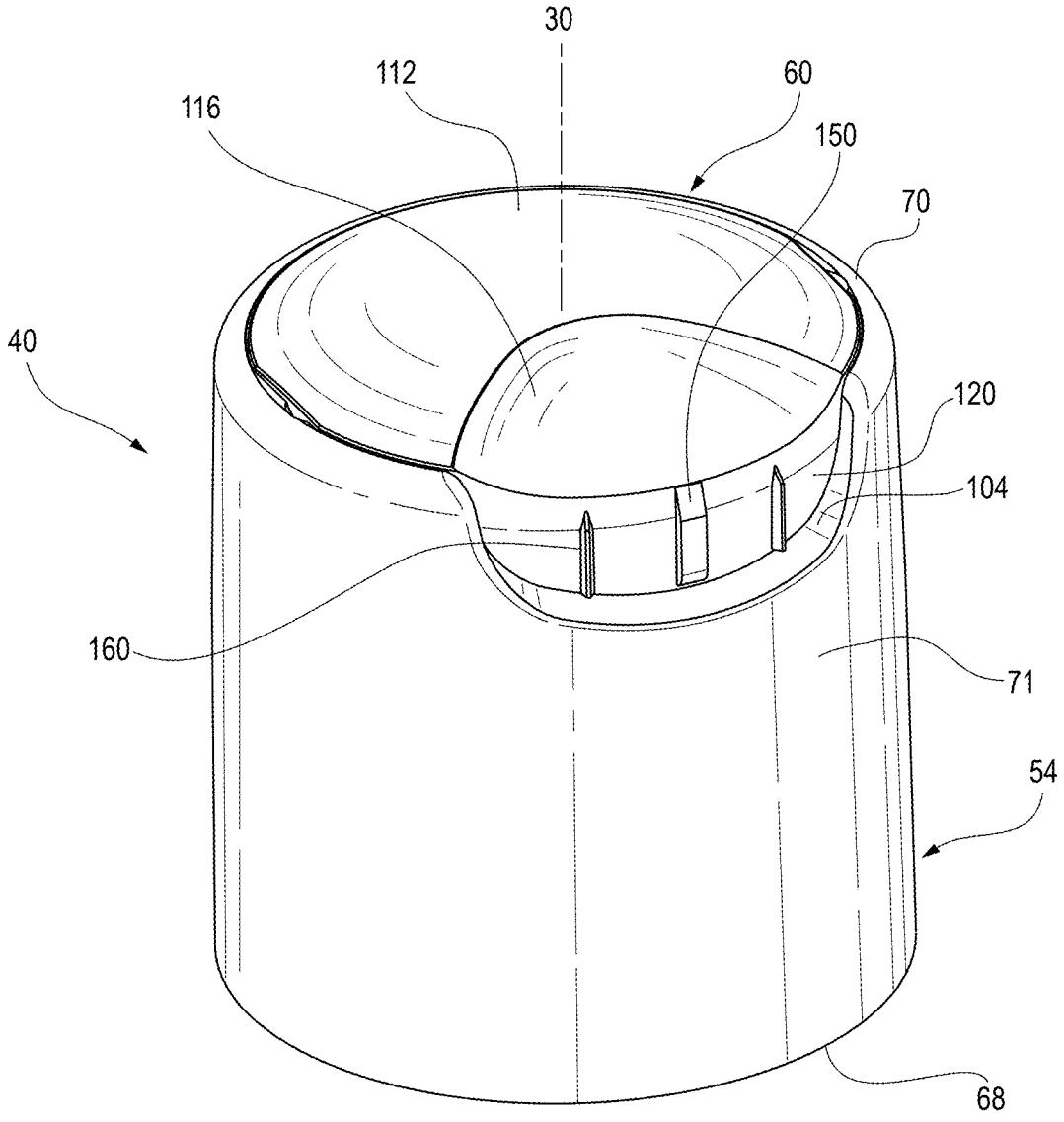
FIG. 1A is an isometric view, taken from above and the rear, of only the dispensing closure of FIG. 1 showing the actuator of the closure in its closed, non-dispensing position or configuration atop the closure body.

While this invention is susceptible of embodiment in many different forms, this specification and the accompanying drawings disclose only specific forms as examples of the invention. The invention is not intended to be limited to the embodiments so described, and the scope of the invention will be pointed out in the appended claims.

For ease of description, many figures illustrating the invention show an embodiment in the typical orientation that the closure would have at the opening of a system that is a container in the form of an upright bottle, and terms such as "inward", "outward", "upper", "lower", "axial", "radial", "lateral", etc., are used with reference to this orientation. The terms "axial" and "radial" are used with respect to a central longitudinal or vertical axis 30 (FIG. 2), generally defined as the axis located within the geometric center of the dispensing closure and extending from the bottom end to the top end of the dispensing closure. The phrase "axially inwardly" refers to the direction along the central axis 30 toward the bottom of the closure and toward the container interior. The phrase "axially outwardly" refers to the opposite direction along the central axis 30 toward the top of the closure and away from the container interior. The phrase "radially inwardly" refers to the direction normal to, and toward, the central axis 30. The phrase "radially outwardly" refers to the direction normal to, and away from, the central axis 30. It will be understood, however, that the closure of this invention may be manufactured, stored, transported, used, and sold in an orientation other than the orientation described.

The dispensing closure, or simply referred to herein as a "closure", of this invention is especially suitable for use with, among other things, a variety of conventional or special systems, including containers, the details of which, although not fully illustrated or described, would be apparent to those having skill in the art and an understanding of such containers. The particular container, per se, that is illustrated and described herein forms no part of, and therefore is not intended to limit, the broadest forms of the present invention. It will also be understood by those of ordinary skill that novel and non-obvious inventive aspects are embodied in the described exemplary closures alone.

The closures described herein are especially suitable for use on a container that contains a fluent material or substance in the form of a lotion or cream that can be dispensed, or otherwise discharged, from the container through the opened closure. Such fluent substances may be, for example, a personal care product, a food product, an industrial product, a household product, or other types of products. Such substances may be for internal or external use by humans or animals, or for other uses (e.g., activities involving medicine, manufacturing, commercial or household maintenance, construction, agriculture, etc.).

A first, presently preferred embodiment of a closure of the present invention, and the components thereof, are illustrated in FIGS. 1-13, wherein the closure is designated generally by the reference number 40. In the first illustrated embodiment, the closure 40 is provided in the form of a separate article which is configured to be attached or assembled to a system such as a container 44 (partly visible in FIG. 1 only) that would typically contain a fluent substance.

The container 44 may be any conventional type, such as a collapsible, flexible pouch, or may be a generally rigid structure that has somewhat flexible, resilient walls, such as a bottle or tank. FIG. 1 shows an embodiment of the closure 40 attached to a container 44 that is a generally rigid bottle having a wall that is somewhat flexible and that can be squeezed by the user to dispense a product when the closure 40 is opened. The closure 40 may instead be used on a larger dispensing system (not illustrated) which may include, or be part of, for example, a medical device, processing machine, dispenser, reservoir on a machine, etc., wherein the system has an opening to the system interior.

The container 44, or a portion thereof, may be made from a material suitable for the intended application (e.g., a thin, flexible material for a pouch, wherein such a material could be a polyethylene terephthalate (PET) film or a polyethylene film and/or an aluminum foil, or a thicker, less flexible material such as molded polyethylene or polypropylene for a more rigid container 44 such as a bottle).

In applications wherein the closure 40 is mounted to a container 44 such as a bottle or pouch (not illustrated), it is contemplated that typically, after the closure manufacturer would make the closure (e.g., by molding parts of the closure 40 from a thermoplastic polymer and assembling them), the closure manufacturer will then ship the closure 40 to a container filler facility at another location where the container 44 is either manufactured or otherwise provided, and where the container 44 is filled with a product prior to installation of the closure. If the container is a collapsible pouch, then the closure may include a suitable fitment portion that can be attached to the pouch as the pouch is being made and filled, or as the pouch is being made but before the pouch is subsequently filled through the open closure or through open regions of the pouch walls that are later sealed closed.

In the illustrated first embodiment of the closure 40, the closure 40 is provided as a separately manufactured article, component, or unit for being screwed onto the container 44. It will be appreciated, however, that in some applications, it may be desirable for the closure 40 to be attached to a container in a manner that would not allow a user to easily remove the closure 40. Further, it may be desirable for the closure (or at least the body of the closure) to be formed as a unitary part, or extension, of the container (e.g., a bottle) wherein such a unitary part or extension also (i.e., simultaneously) defines an end structure of the container, per se.

With reference to FIG. 1, where the illustrated container 44 is a bottle, the bottle typically includes an upper end portion (or other suitable structure on some part of the bottle) that defines the bottle mouth or opening and a threaded portion (or snap-fit bead, not illustrated) for mating with a cooperating threaded portion (or snap-fit bead, not illustrated) of the closure 40, which is discussed in detail hereinafter. The bottle upper end portion typically has a cross-sectional configuration with which the closure 40 is adapted to engage. Extending from the upper end portion is a main body portion of the bottle. The main body portion typically has a cross-sectional configuration that differs from the cross-sectional configuration of the bottle upper end portion at the bottle opening. In other types of bottles, the bottle may instead have a substantially uniform shape along its entire length or height without any portion of reduced size or different cross-section.

The first illustrated embodiment of the closure 40 is especially suitable for use with a container 44 that is a bottle having a substantially flexible wall or walls that can be squeezed or deflected laterally inwardly by the user to increase the internal pressure within the bottle so as to force the fluent substance out of the bottle and through the opened closure 40. The walls have sufficient, inherent resiliency so that when the squeezing forces are removed, the bottle walls return to the normal, unstressed shape.

In other applications it may be desirable to employ a generally rigid container, and to pressurize the container interior at selected times with a piston or other pressurizing system (not illustrated), or to reduce the exterior ambient pressure so as to suck the material out through the open closure.

In some other applications, the closure 40 may be used with a product containment system or other type of system (not illustrated), where the closure 40 can function to permit or prevent the egress or ingress of substances relative to the system in which the closure 40 is installed.

For example, in some applications it may be desirable to also accommodate filling or refilling of the container 44 (or other system) with the fluent contents through the opened closure 40 into the container 44.

Figure 2:
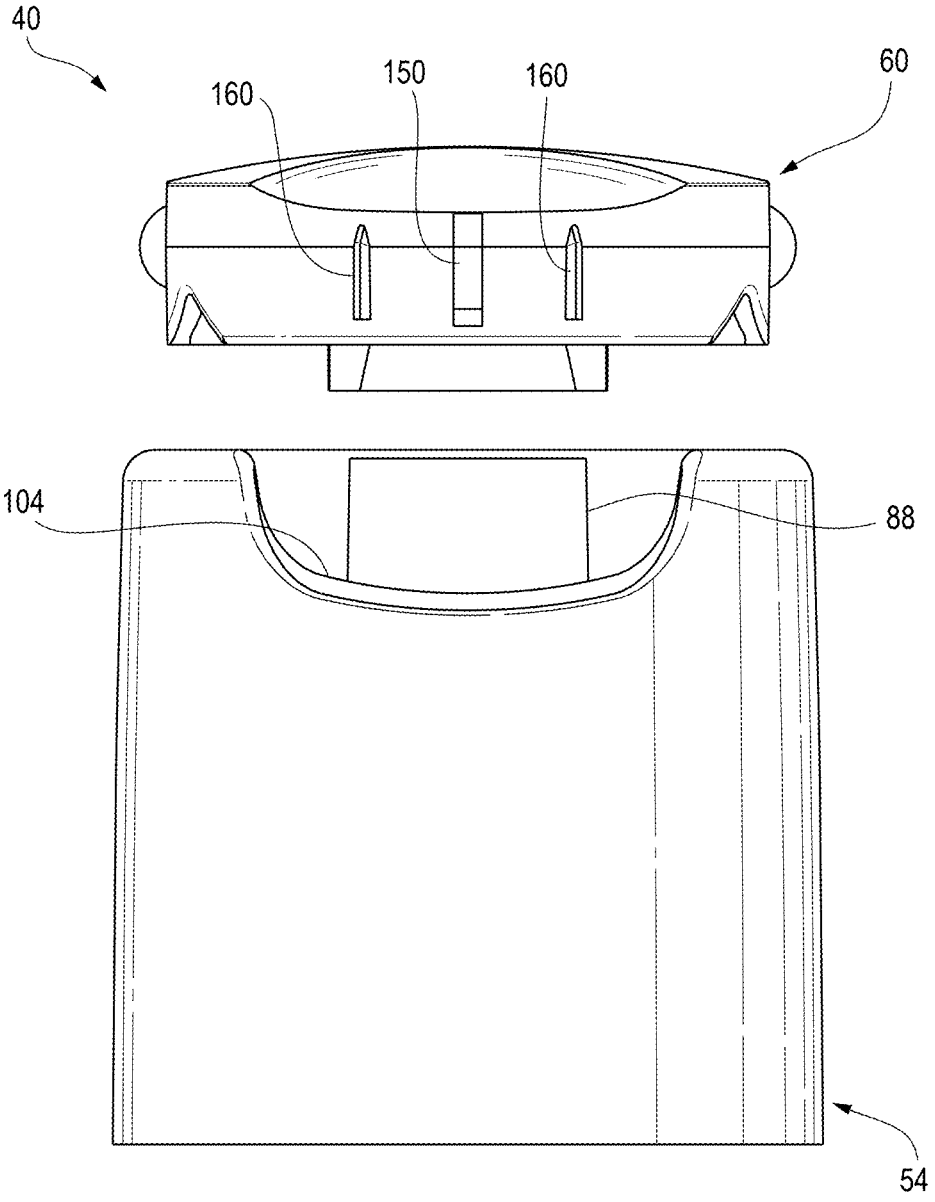
FIG. 2 is an exploded, rear elevation view of the dispensing closure illustrated in FIG. 1.
Figure 3:
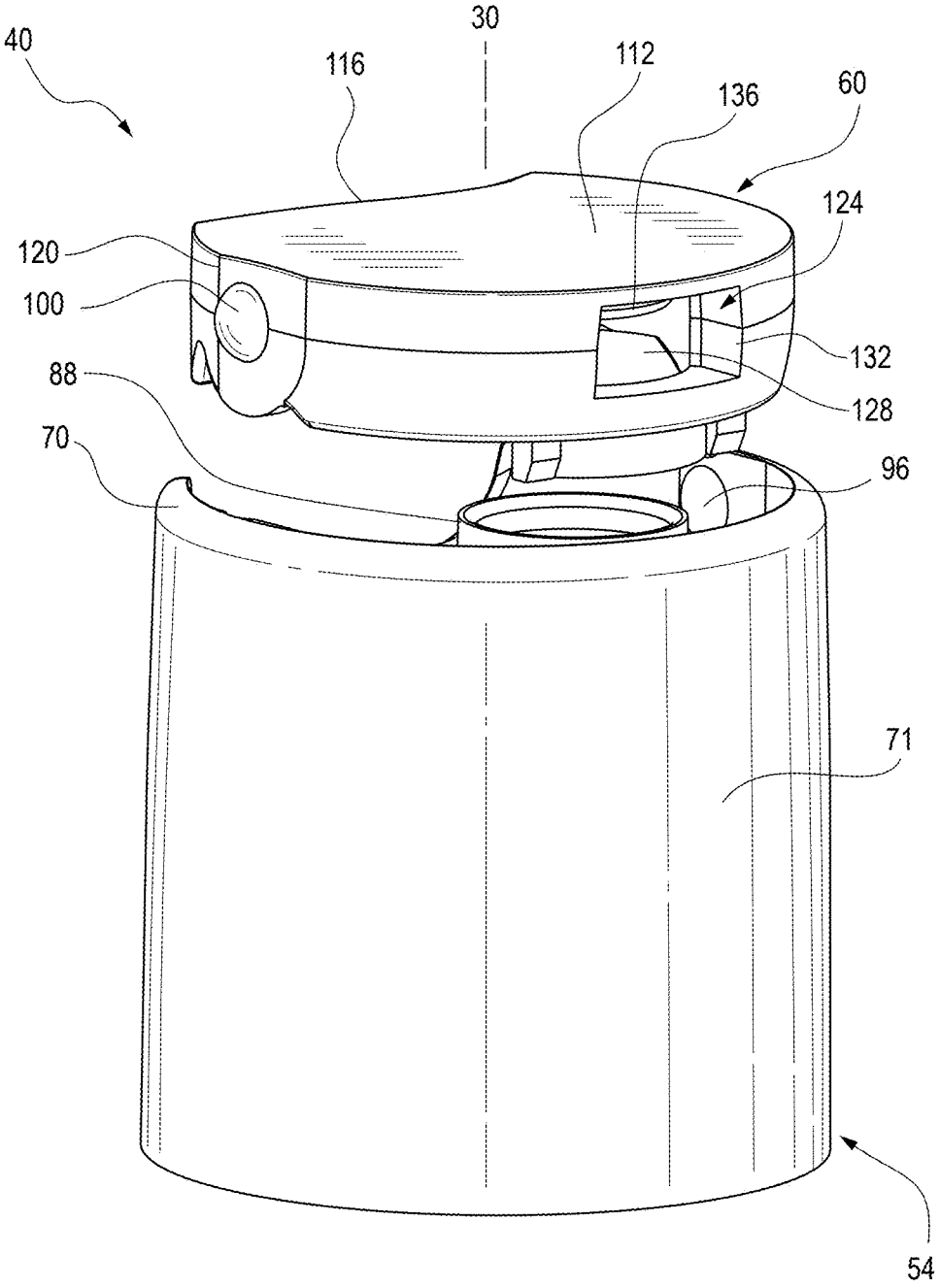
FIG. 3 is an exploded, isometric view, taken from the front and left side, of the dispensing closure illustrated in FIG. 1.

With reference to FIGS. 2 and 3, the closure 40 includes the following basic components: a base or closure body 54 and an actuator 60 that is movable or pivotable relative to the closure body 54. An optional cap or lid (not illustrated) could be provided for being removably mounted atop of the closure 40. The closure body 54 and the actuator 60 are preferably formed or molded as separate structures and subsequently assembled together. The closure body 54 and the actuator 60 are each preferably molded from a suitable thermoplastic material such as polyethylene or polypropylene. Other materials may be employed instead. It will be understood that in alternative designs (not illustrated), two or more of the basic components may be unitarily formed or molded together initially as one connected structure, and then substantially broken apart, and then assembled in an operative combination. Further, it will be understood that the closure body 54 may be unitarily formed or molded as an extension of the upper end of the container 44.

The actuator 60 is movable between an open, dispensing position (FIG. 13) and a non-dispensing, closed position (FIG. 1).

Figure 8:
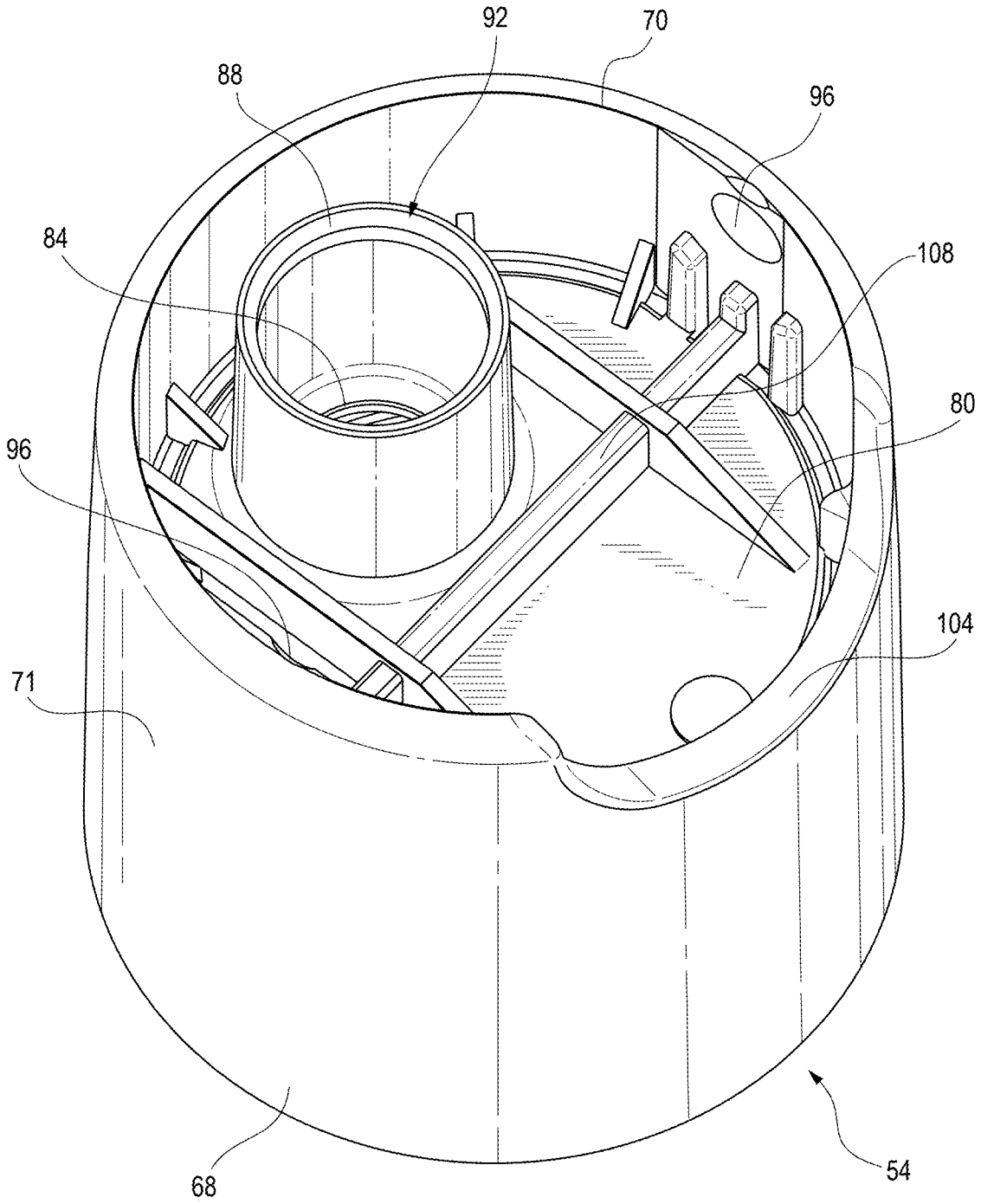
FIG. 8 is an isometric view, taken from above and the right side, of the closure body of FIG. 7.
Figure 9:
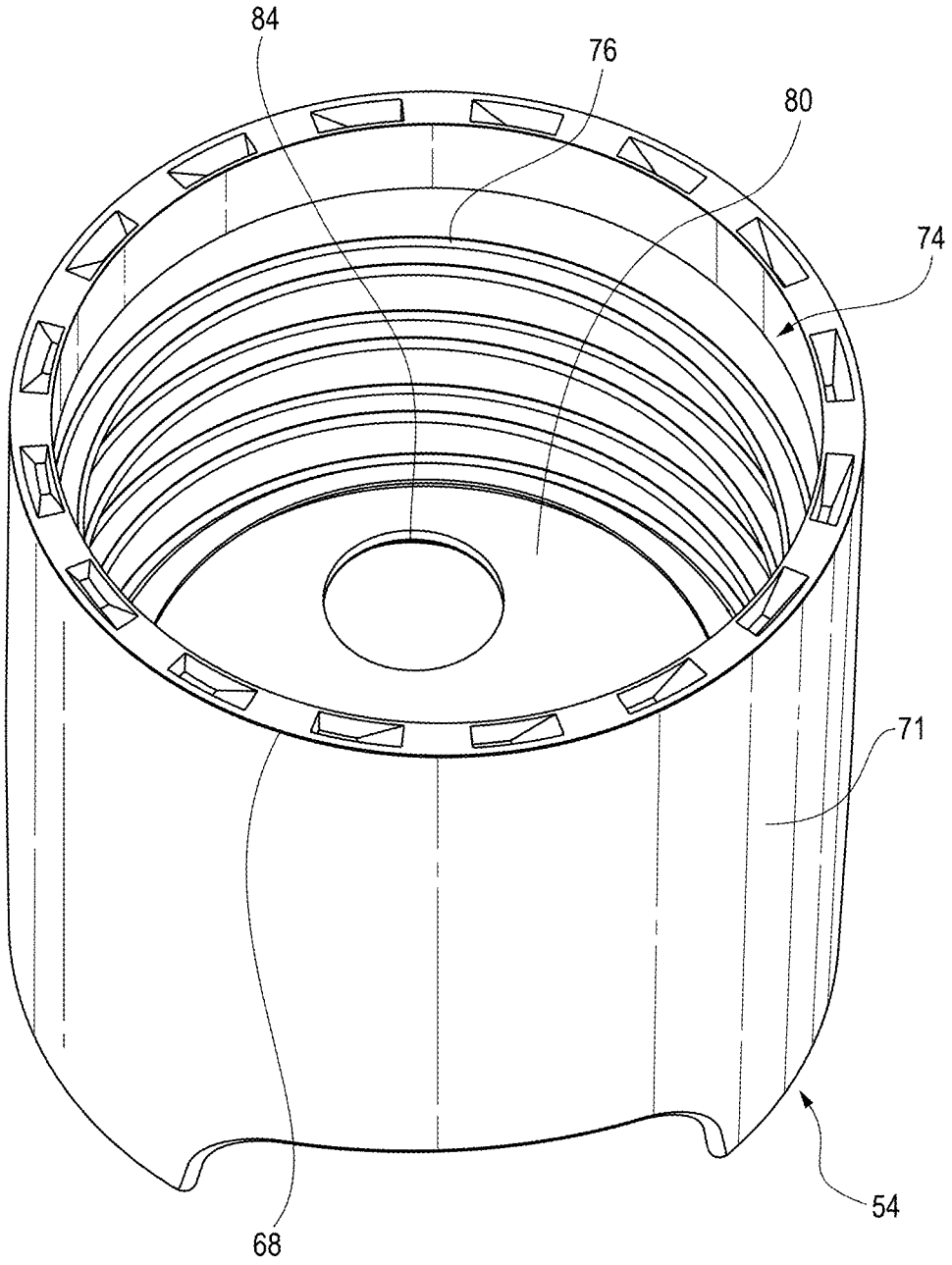
FIG. 9 is an isometric view, taken from below and the left side, of the closure body of FIG. 7.

Referring now to FIGS. 1, 8, and 9, the closure body 54 includes an inlet portion or lower end 68 and an upper end 70. A cylindrical skirt or outer wall 71 extends between the lower end 68 and the upper end 70. The lower end 68 defines an inlet or passage 74 (visible in FIG. 9) for being located at the opening of the bottle 44 (FIG. 1) to communicate with an interior of the bottle 44 containing a fluent substance.

Referring to FIG. 9, the interior of the closure body 54 is provided with a plurality of internal or female threads 76 extending radially inwardly from the outer wall 71. The internal threads cooperate with, and threadingly engage, mating external or male threads (not visible in FIG. 1) located on the exterior of the container 44 to securely attach the closure body 54 together with the container 44 (FIG. 1) at the opening of the container 44. It will be appreciated that other conventional or special means of connecting the closure body 54 to the container 44 could be employed, such as mating snap-fit beads, bi-injection molding, adhesives, mechanical locks, spin welding of the closure to the container, etc.

If the closure body 54 is to be used on a flexible pouch (not illustrated), then it is presently contemplated that the closure body lower end 68 would have a suitable boat-shaped fitment configuration (e.g., such as the fitment body shown in International Patent Application Publication No. WO 2014/193358 A1, which is incorporated by reference herein in its entirety) for being sealed with the pouch, and most pouch manufacturers will prefer to install the closure body lower end at an opening formed in the pouch with heat sealing techniques or ultrasonic sealing techniques.

Referring now to FIG. 8, the closure body 54 includes an internal deck 80 that extends in a transverse manner relative to the outer wall 71. The deck 80 further has a circular, aperture 84 that opens to (i.e., communicates with) the interior of the container 44. A spout 88 surrounds the aperture 84 and extends from the deck 80 to define a body flow passage 92. While the closure body 54 is illustrated as having a generally cylindrical structure that is substantially centered on the axis 30 (FIG. 1), it will be appreciated, however, that the closure body 54 may take a variety of forms and need not be limited to a cylindrical shape and need not have circular cross-sections as shown. For example, the lower end 68 and/or the upper end 70 may be elliptical, polygonal, or some irregular shape.

Figure 6:
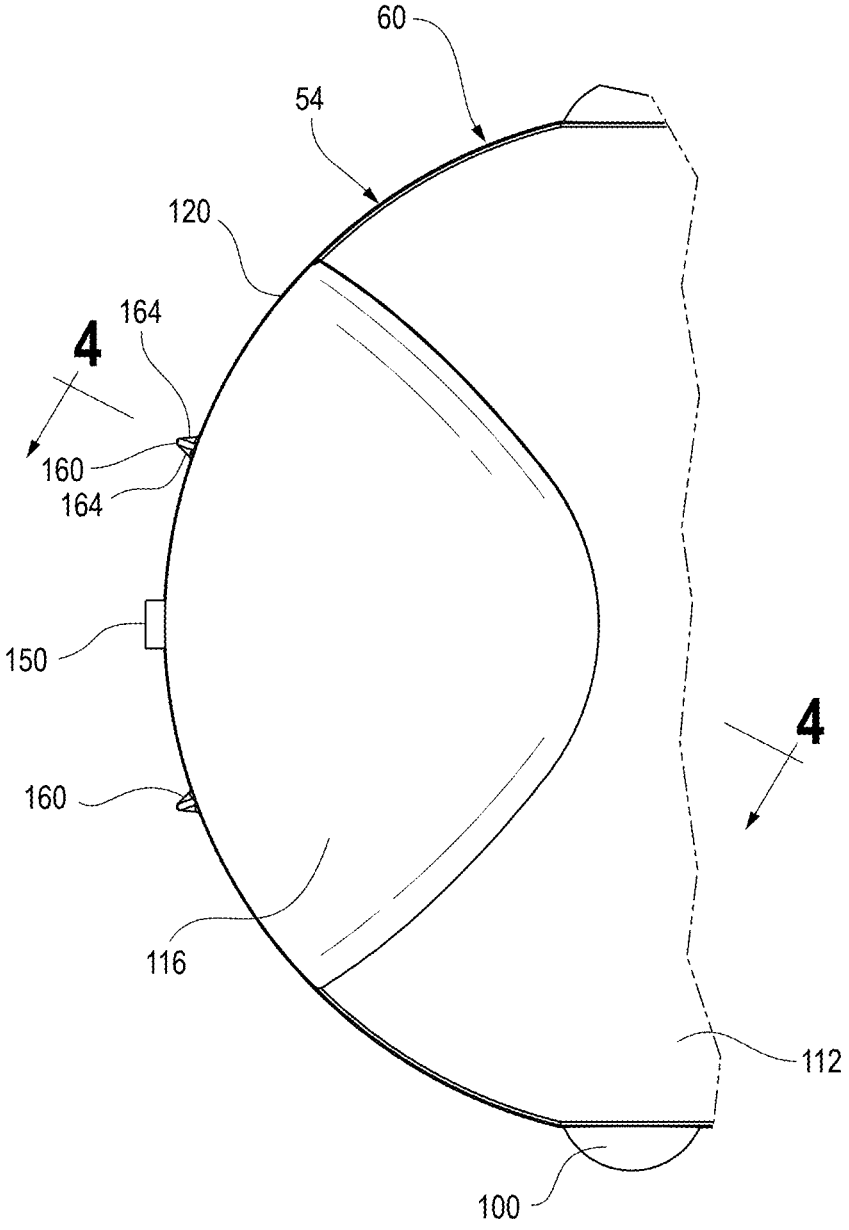
FIG. 6 is an enlarged, fragmentary, top elevation view of the rear back region of the actuator of the dispensing closure of FIG. 1.
Figure 6A:
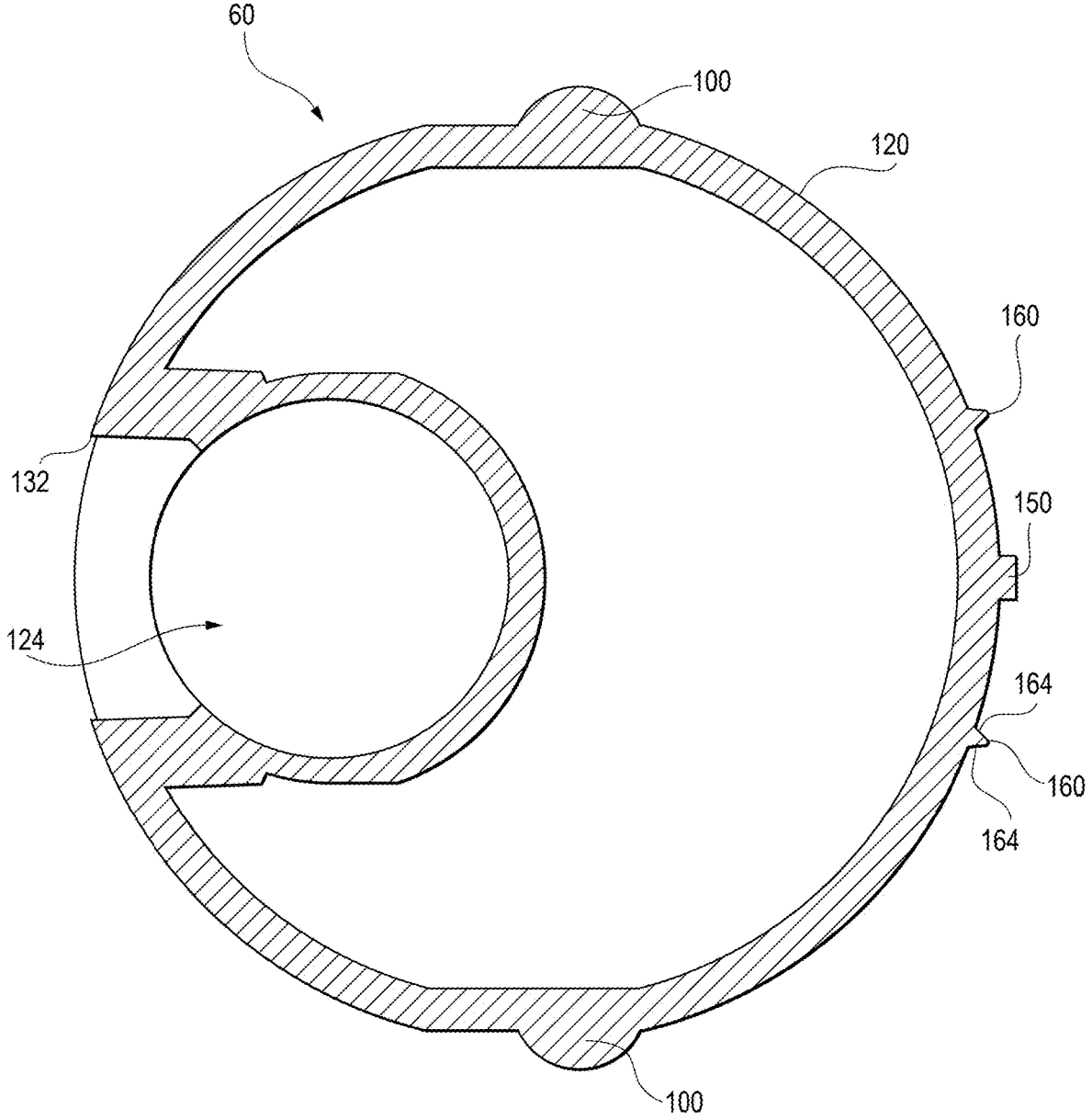
FIG. 6A is an enlarged, cross-sectional view of the actuator of the dispensing closure of FIG. 1, taken generally along a horizontal plane that is perpendicular to the central vertical axis of the dispensing closure.
Figure 7:
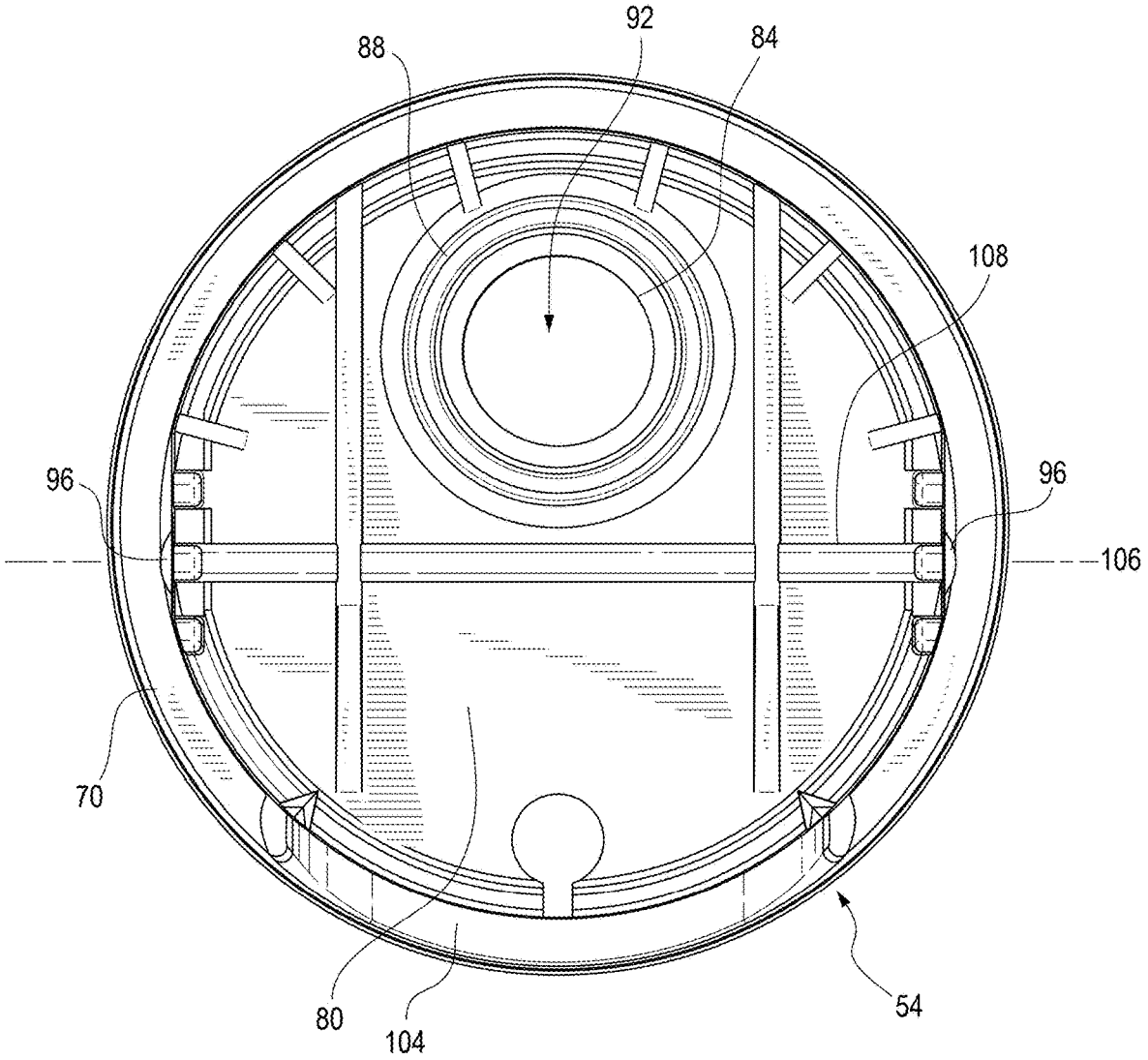
FIG. 7 is a top plan view of only the closure body of the dispensing closure of FIG. 1.

With reference to FIGS. 3 and 7, the inside of the wall 71 of the closure body 54 is provided with a pair of opposing detents or hemispherical recesses 96 that serve to retain mating hemispherical protrusions or trunnions 100 (FIGS. 3 and 6) formed on oppositely-facing left and right sides of the actuator 60 as discussed in detail below.

As can be seen in FIG. 1, a rear portion of the wall 71 includes a cut-away or recessed area 104 to accommodate a user's finger (e.g., thumb or forefinger) during actuation of the actuator 60, as will be discussed herein. The recessed area 104 has a sloping upper surface 105 (best viewed in a vertical cross-section as in FIGS. 10-13) for confronting a feature on the actuator 60, as will be discussed in greater detail hereinafter.

Referring now to FIGS. 7 and 8, the deck 80 includes a central rib 108 that bisects the closure body 54 when viewed from above. The central rib 108 extends between opposite sides of the wall 71, beneath the hemispherical recesses 96. The central rib 108 strengthens the closure body 54 and also functions to support the actuator 60 during pivoting movement of the actuator 60 with respect to the closure body 54, and to prevent undesirable vertical movement of the body 54 with respect to the actuator 60 during pivoting thereof, as will be discussed in detail hereinafter. The closure body 54 defines a pivot axis 106 (visible in FIG. 7) about which the actuator 60 may pivot with respect to the body 54, the operation of which is discussed hereinafter.

As shown in FIGS. 1 and 6, the actuator 60 has a generally disc-like shape with a front region 112 and a back region 116 designed to accommodate the finger of a user of the closure 40 during opening of the actuator 60. The actuator 60 has an annular circumferential or side wall 120 with the aforementioned pair of semispherical protrusions or trunnions 100 spaced 180 degrees apart from one another, and separating the front and back regions 112 and 116, respectively. Each one of the protrusions 100 fits within one of the recesses 96 in the body 54.

Figure 4:
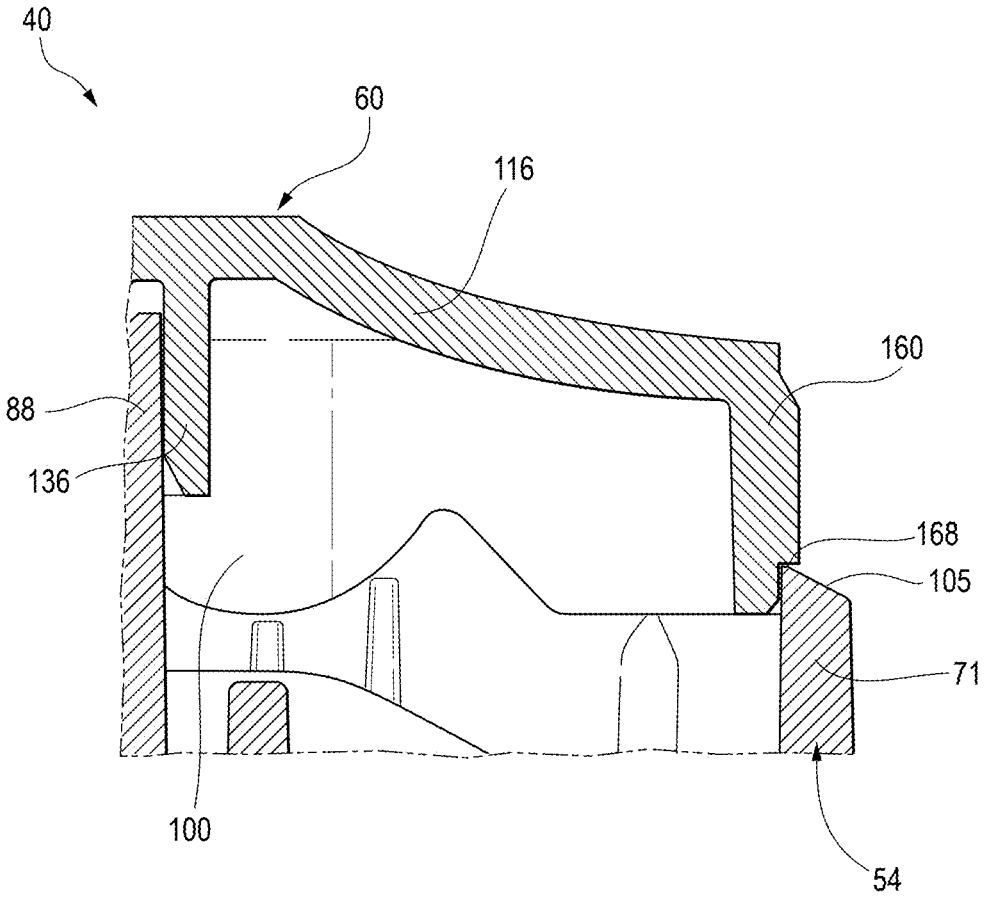
FIG. 4 is an enlarged, fragmentary, cross-sectional view of the dispensing closure illustrated in FIG. 1, taken generally along the plane 4-4 in FIG. 6.

As illustrated in FIG. 3, the actuator 60 is provided with a dispensing flow passage 124 having an inlet end 128 and an outlet end 132 on the exterior of the actuator 60. The actuator 60 has a plug or internal annular wall 136 that extends downwardly therefrom to seal against the inside of the spout 88 (as shown in FIG. 4) when the actuator 60 is in the closed position.

Figure 10:
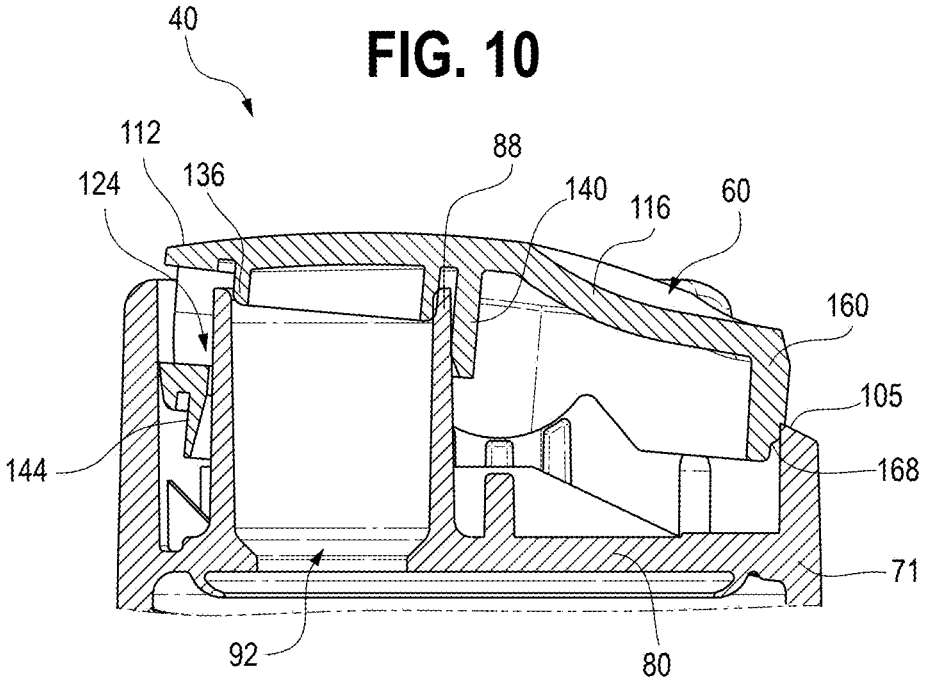
FIG. 10 is a fragmentary, cross-sectional view of the dispensing closure illustrated in FIG. 1, taken generally along a vertical plane extending through one of the ribs on the actuator.
Figure 11:
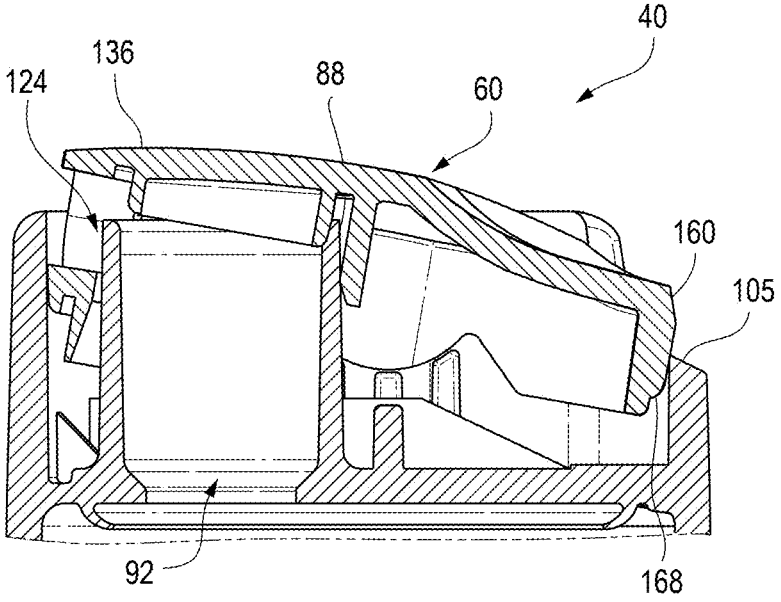
FIG. 11 is a fragmentary, cross-sectional view of the dispensing closure illustrated in FIG. 1, taken generally along a vertical plane extending through one of the ribs on the actuator.
Figure 12:
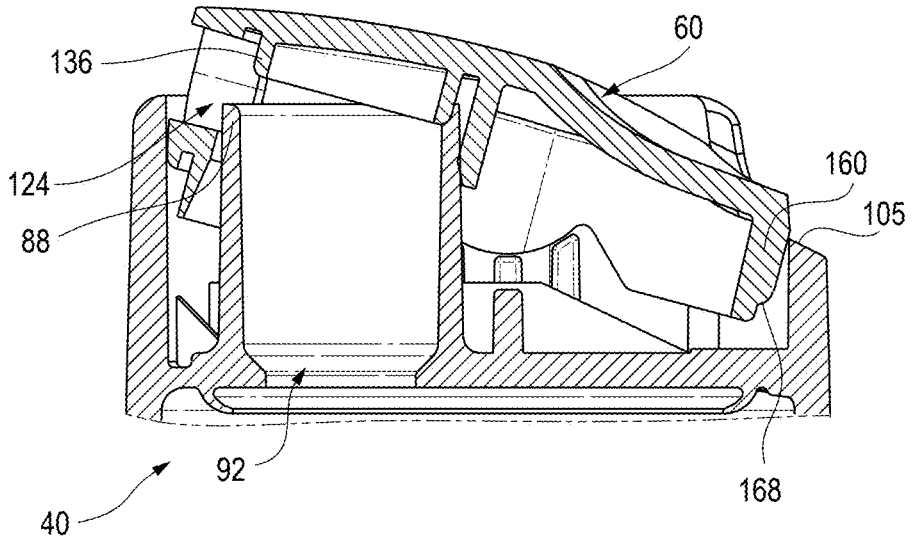
FIG. 12 is a fragmentary, cross-sectional view of the dispensing closure illustrated in FIG. 1, taken generally along a vertical plane extending through one of the ribs on the actuator.
Figure 13:
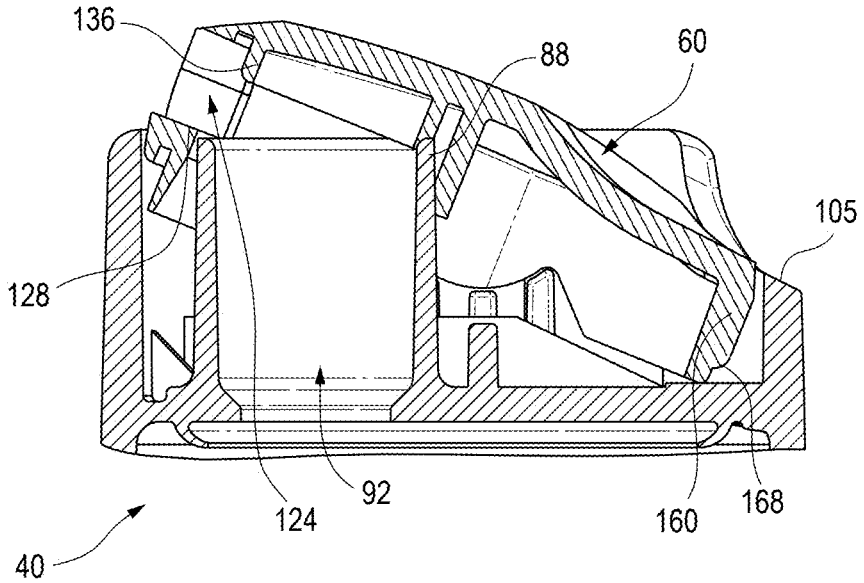
FIG. 13 is a fragmentary, cross-sectional view of the dispensing closure illustrated in FIG. 1, taken generally along a vertical plane extending through one of the ribs on the actuator.

With reference to FIG. 10, a first semi-circular sealing rim 140 and a second semi-circular sealing rim 144 extend downwardly in the actuator 60 to maintain a fluid tight seal between the spout 88 and the actuator 60 such that the outlet end 132 of the dispensing flow passage 124 is the only path of egress for a fluent substance when the actuator 60 is in the open position.

Figure 5:
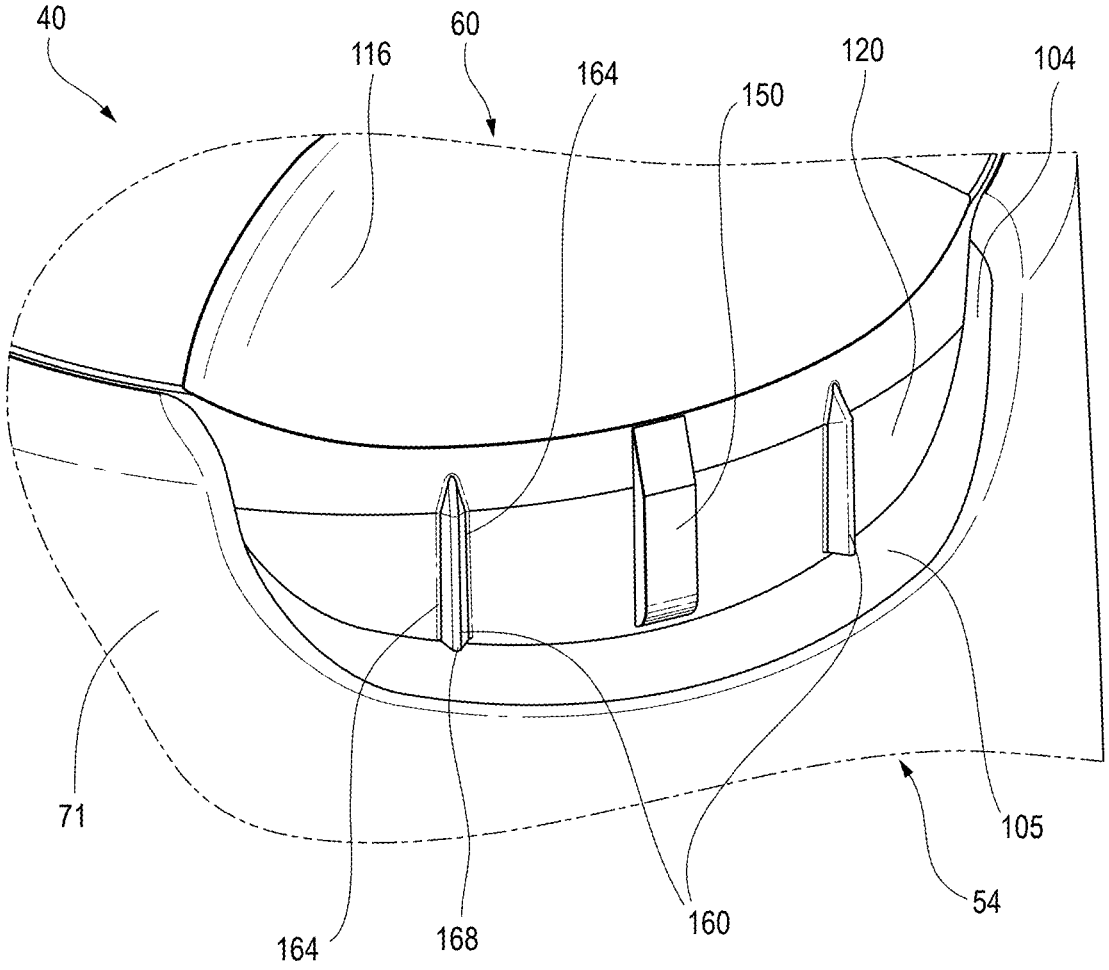
FIG. 5 is an enlarged, fragmentary, isometric view, taken from the rear and right side, of the dispensing closure illustrated in FIG. 1.

With reference to FIGS. 1, 2, and 5, the rear portion of the annular side wall 120 of the actuator 60 has a central wedge-shaped projection or cam element 150 extending therefrom. The cam element 150 is located at the back (i.e., rear portion) of the actuator 60 at the back region 116 and functions to frictionally engage the inside of the wall 71 of the closure body 54. The frictional engagement of the cam element 150 with the wall 71 functions to stabilize the actuator 60 to maintain the actuator 60 in the open position after the user has pivoted the actuator 60 to the desired open position.

Referring now to FIGS. 5 and 6, the back region 116 of the actuator, and more particularly the annular side wall 120, is further provided with one or more projections or ribs 160 that function to confront the recessed portion 104 of the closure body wall 71 to initially resist movement of the actuator 60 from the closed, non-dispensing position to the open, dispensing position. As will be discussed in greater detail hereinafter, the ribs 160 have an initial configuration prior to initial movement of the actuator 60 into its open, dispensing position, and the ribs 160 have a permanently deformed configuration after initial movement of the actuator 60 into the open, dispensing position. The preferred, first illustrated embodiment of the closure 40 includes a pair of ribs 160 that are equally-spaced apart on opposite sides of the cam element 150, defining a central angle relative to the axis 30 of between about thirty degrees and about fifty degrees (when viewed from above as in FIG. 6).

As can be seen in FIG. 5, the ribs 160 extend in a longitudinal direction that is generally parallel to the central axis 30 of the closure 40. Each one of the ribs 160 has a generally or substantially triangular cross-sectional shape, taken in a horizontal plane that is normal to the central axis 30 of the closure 40. Each one of the ribs 160 includes or defines a pair of angled side walls 164 that terminate in a longitudinally-extending edge. The terminal edge of each one of the ribs 160 is radially-oriented relative to the central axis 30. The lower part of the rib includes a substantially flat abutment face 168 for abutting or confronting the sloping upper surface 105 (FIG. 4 in the closed position of the actuator 60) of the recessed back portion 104 closure body 54.

The ribs 160 are configured to define a first force requirement to be overcome by the user so as to pivot the actuator 60 from the closed position into the open position, and then the ribs 160 are further configured to define a second force requirement to be overcome by the user for subsequent movement of the actuator 60 into the closed position—whereby the second force requirement is substantially reduced from the first force requirement and much more comfortable to a user the closure. The inventors have found that the flat or near-flat abutment face 168 of the rib bottoms allows for a tight fit to the body 54 and limits unintended opening of the actuator 60 prior to consumer use. Furthermore, the inventors have found that the angled side walls 164 of the ribs 160 allows for the ribs 160 to deform more easily during intended consumer opening compared to other configurations.

The inventors have found that the configuration of the actuator 60 and body 54 of the present invention exhibits improved leak resistance compared to the prior art closures, while still maintaining a robust guard against premature operation. Unlike frangible connections of the prior art, there are no appreciable sharp edges or debris caused by the initial deformation of the ribs 160 or caused by subsequent, repeated pivoting of the actuator 60 relative to the body 54. Furthermore, unlike the prior art, there are no frangible parts or pieces that may become dislodged or trapped beneath the actuator 60 and above the body 54, which may interfere with the proper operation of the closure 40. The closure 40 advantageously may be operated by a consumer without the need for any additional steps, hand motions, or required indicia as would be the case for twisting type locking closures of the prior art.

One method of assembling the components of the closure 40 is next discussed with initial reference to FIGS. 2 and 3. It will be understood that the method of assembly described herein is illustrative only, and there may be other methods of assembling the components of the closure 40. The actuator 60 and the closure body 54 may be assembled by first orienting the recesses 96 on the interior of the annular wall 71 of the body 54 with the hemispherical projections 100 of the actuator 60 such that the back region 116 of the actuator 60 is located proximal to the recessed area 104 of the wall 71. The actuator 60 and body 54 may be subsequently brought together along axis "30" until the hemispherical projections 100 are pressed into the two the recesses 96, such that the actuator 60 is oriented in the closed, non-dispensing position. As can be seen in FIG. 4, the plug 136 of the actuator 60 seals against the inside of the spout 88 when the actuator 60 is assembled with the body 54 and oriented in the non-dispensing, closed position. One or both of the components of the body 54 and actuator 60 are sufficiently resilient to accommodate the assembly of the two components. In some forms of the present invention, the projections 100 may have other shapes, such as cylindrical pivots, etc., which are known in the art.

The detailed operation and function of the closure 40 will next be described with initial reference to FIG. 1. Typically, a user will encounter the closure 40 as shown in FIG. 1, with the closure 40 installed upon the top end of a container 44 of a fluent substance—the closure 40 and the container 44 of the fluent substance altogether defining a package. A removable adhesive, tape, or plastic wrap (not illustrated) may optionally be provided over the top of the actuator 60 of the closure 40 for purposes of providing a redundant seal or tamper-evident feature. If such a seal or tamper evident feature is provided, the user would initially remove it from the closure 40 to expose the actuator 60 prior to initial operation of the closure 40.

The user would typically encounter the closure 40 with the actuator 60 oriented in the non-dispensing, closed position. In this position, each rib 160 and each flat abutment face 168 is undeformed and oriented in a confronting position (touching or minimally spaced from) the sloping upper surface 105 of the closure body wall 71. The sloping upper surface 105 terminates in a top edge that is located near the point where the rib 160 extends from the circumferential wall 120 of the actuator 60. At this stage in operation of the closure 40, if the user attempts to move the actuator 60 from the closed position into the open position (e.g., by depressing the back region 116 of the actuator 60 to attempt to cause the actuator 60 to pivot within the recesses 96 of the closure body 54), then the user would be inhibited from doing so by contact of the sloping upper surface 105 with the flat abutment face 168. The initial closed position of the actuator 60 prevents, or at least minimizes, the likelihood for accidental dispensing or spilling of the fluent substance if the package is accidentally inverted and/or perhaps accidentally impacted to create a slight increase in internal pressure.

With reference to FIGS. 10-13, the user begins to initially open the closure 40 to the open, dispensing position by depressing the back region 116 of the actuator 60 to cause the actuator 60 to pivot within the recesses 96 of the body 54. As the user presses on the back region 116 of the actuator 60, the user must overcome a predetermined, first, or initial force to cause the flat abutment face 168 to deform sufficiently to slip axially inwardly (downwardly) past the sloping upper surface 105, permitting the two hemi-spherical projections 100 to rotate within the recesses 96 of the body 54 such that the actuator 60 pivots about the pivot axis 106.

The cam element 150 slides down into closure body 54 against the wall 71 when the actuator 60 moves into the open position. The cam element 150 stabilizes and maintains the actuator 60 in the open position by frictional engagement with the wall 71 of the body 54.

Referring to FIGS. 10-13, as the actuator 60 pivots open, the plug 136 lifts partially out of the spout 88 so that the outlet end 132 (visible in FIG. 3) of the dispensing flow passage 124 is exposed to the ambient environment. The user may then grasp the flexible, resilient container 44 to collapse or otherwise reduce the internal volume of the container 44 to pressurize the fluent substance contained therein. In some situations, the user may also invert the container 44. During dispensing of the fluent substance, the fluent substance initially enters the inlet flow passage 74 of the closure body 54, flows through the body flow passage 92, enters into the dispensing flow passage 124 of the actuator 60, and exits the closure 40 from the exposed outlet end 132 of the actuator 60.

When the user ceases to squeeze (i.e., pressurize) the container 44, the outward flow of the fluent substance is stopped and may even be sucked back toward the container 44 by a temporary lower pressure within the container 44 (e.g., if the container has resilient walls that return from a "squeezed in" configuration to the normal undeformed configuration). This allows some of the fluent substance within the dispensing flow passage 124, the body flow passage 92, and/or the inlet flow passage 74 to be forced by the greater ambient air pressure back through the closure 40 and toward the container 44 to help maintain the overall cleanliness of the package.

The user may then move the actuator 60 from the open position (FIG. 13) back into the closed position (FIGS. 1 and 4) by depressing the front region 112 of the actuator 60 (which is located on the opposite side of the pivot axis from the back region 116) to cause the two hemi-spherical projections 100 to pivot within the recesses 96 of the body 54. The pivoting movement of the actuator 60 causes the plug 136 to re-seal within the spout 88 and also conceals the outlet end 132 of the dispensing flow passage 124 from the ambient environment.

When the user subsequently moves the actuator 60 relative to the closure body 54 into the open position, the user must only overcome the second force from the ribs 160, which is predetermined and configured to be substantially less than the first or initial actuation force discussed above.

Figure 14:
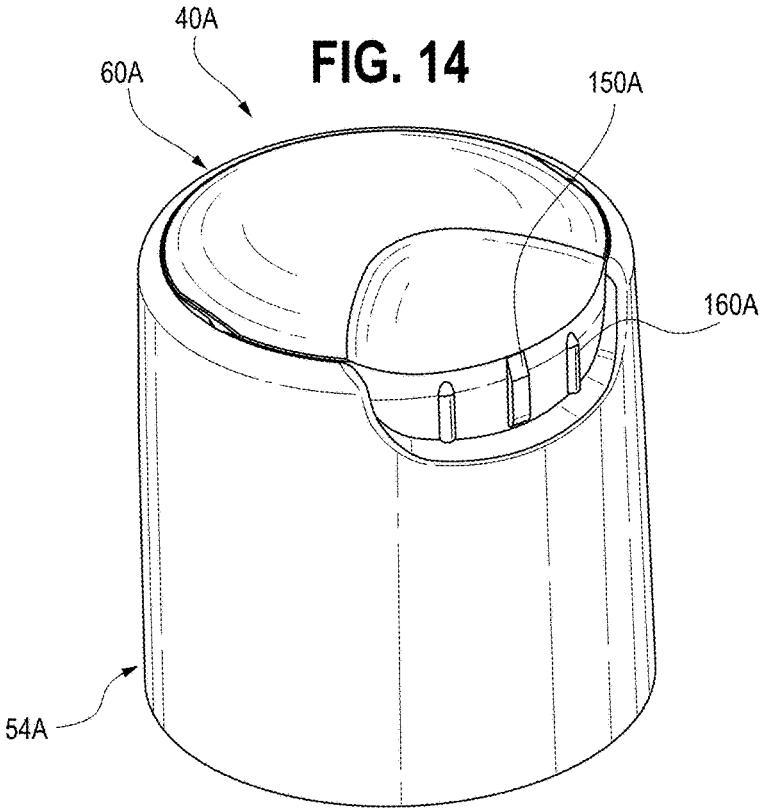
FIG. 14 is an isometric view, taken from above and rear, of a second illustrated embodiment of a dispensing closure of the present invention.
Figure 15:
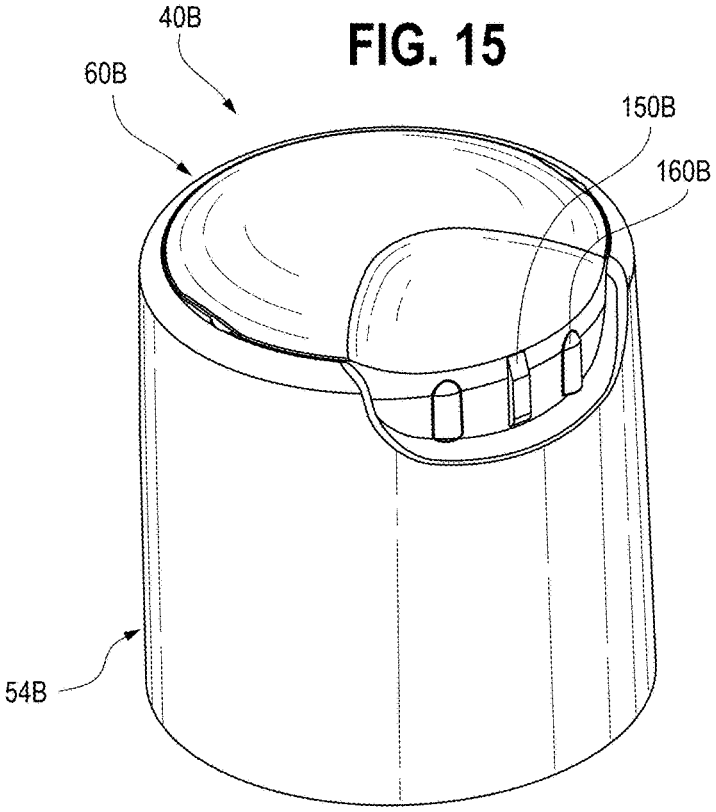
FIG. 15 is an isometric view, taken from above and rear, of a third illustrated embodiment of a dispensing closure of the present invention.

With reference now to FIGS. 14 and 15, second and third illustrated embodiments of the closure according to the present invention are designated as 40A and 40B, respectively. Like elements between the first illustrated embodiment of the closure 40 and the second and third illustrated embodiments of the closure 40A and 40B are designated with the same numeral (the first embodiment having no suffix, the second embodiment having an "A" suffix, and the third embodiment having a "B" suffix).

The second illustrated embodiment of the closure 40A has the same basic elements of the closure body 54A and actuator 60A, and functions in the same manner as the first illustrated embodiment of the closure 20. However, the closure 40A includes a modified pair of ribs 160A having a rounded or semi-circular cross-sectional shape when viewed in a horizontal plane that is perpendicular to the longitudinal axis of the closure 40A.

The third illustrated embodiment of the closure 40B has the same basic elements of the closure body 54B and actuator 60B, and functions in the same manner as the first illustrated embodiment of the closure 20. However, the closure 40B also includes a modified pair of ribs 160B having a greatly increased, rounded or semi-circular cross-sectional shape when viewed in a horizontal plane that is perpendicular to the longitudinal axis of the closure 40B. Furthermore, the distance of the ribs 160B from the central cam element 150B is decreased around the circumference of the actuator 60B to compensate for the increased interference with the closure body 54B owing to the larger cross-sectional surface area of each rib 160B.

Various modifications and alterations to this invention will become apparent to those skilled in the art without departing from the scope and spirit of this invention. Illustrative embodiments and examples are provided as examples only and are not intended to limit the scope of the present invention.

What is claimed is:

1. A dispensing closure for a system having an opening between an exterior of the system and an interior of the system where a fluent substance may be stored, said dispensing closure comprising:

A. a closure body that 1) can be located at the system opening and that defines a lower end for communicating with the system, 2) has an upper end, and 3) has a body flow passage to accommodate the flow of a fluent substance through said closure body;

B. an actuator that 1) is rotatably mounted to said closure body for occluding said body flow passage to prevent flow of a fluent substance through said dispensing closure when said actuator is in a closed, non-dispensing position and for permitting flow of a fluent substance through said dispensing closure when said actuator is rotated to an open, dispensing position, 2) includes a dispensing flow passage having an inlet end that is in communication with said body flow passage and having an outlet end which permits dispensing through said actuator in said open, dispensing position, and 3) includes a back region opposite said outlet end and having a central cam element for frictionally engaging said closure body to maintain said actuator in said open, dispensing position, and said back region includes at least one rib located adjacent said central cam to resist said actuator from moving into said open, dispensing position, said at least one rib having an initial configuration prior to movement of said actuator into said open, dispensing position and said at least one rib having a permanently deformed configuration after movement of said actuator into said open, dispensing position.

2. The dispensing closure in accordance with claim 1 in which said at least one rib has the form of a pair of ribs located on said back region and on opposite sides of said central cam element.

3. The dispensing closure in accordance with claim 2 in which said pair of ribs are equidistantly spaced from said central cam element along a circumference of said back region.

4. The dispensing closure in accordance with claim 2 in which said closure body defines a central axis extending between said lower end and said upper end, and said pair of ribs define a central angle of between about 30 degrees and about 50 degrees relative to said central axis.

5. The dispensing closure in accordance with claim 1 in which said closure body defines a central axis extending between said lower end and said upper end, and said at least one rib extends parallel to said central axis along said back region.

6. The dispensing closure in accordance with claim 1 in which said closure body defines a central axis extending between said lower end and said upper end, and said at least one rib has a substantially triangular cross-sectional shape in a plane that is normal to said central axis.

7. The dispensing closure in accordance with claim 1 in which said closure body defines a central axis extending between said lower end and said upper end, and said at least one rib has a substantially semi-circular cross-sectional shape in a plane that is normal to said central axis.

8. The dispensing closure in accordance with claim 1 in which said closure body defines a central axis extending between said lower end and said upper end, and said at least one rib has a substantially flat abutment face for confronting said closure body in said closed, non-dispensing position, said abutment face extending in a plane that is normal to said central axis.

9. The dispensing closure in accordance with claim 1 in which said actuator is configured with a first actuation force when first moved between said closed, non-dispensing position and said open, dispensing position, and said actuator is configured with a second actuation force when subsequently moved between said closed, non-dispensing position and said open, dispensing position, said first actuation force being greater than said second actuation force.

10. The dispensing closure in accordance with claim 1 in which said closure body defines a central axis extending between said lower end and said upper end, said at least one rib defines a pair of angled side walls that terminate in an edge that extends substantially parallel to said central axis.

11. The dispensing closure in accordance with claim 1 in which said closure body defines an outer wall, said outer wall terminating in a sloping upper surface confronting said at least one rib, said sloping upper surface arranged to slope downwardly in a direction away from said at least one rib.

12. The dispensing closure in accordance with claim 1 wherein an initial movement of said at least one rib from said initial configuration into said permanently deformed configuration does not generate any frangible pieces of said actuator and/or said closure body.

13. The dispensing closure in accordance with claim 1 wherein said at least one rib and said central cam element are integrally formed with said actuator.

14. The dispensing closure in accordance with claim 1 in combination with a system that is a container of a fluent substance, the closure and the container together defining a package.

15. The dispensing closure in accordance with claim 1 in which said closure body is adapted for use with a system that is a container defining said opening and in which said closure body is one of: a separate structure for being attached to the container at the container opening; or an integral structure that is a unitary part of a container formed at the container opening.

* * * * *